US010878764B2

(12) United States Patent
Kim et al.

(10) Patent No.: US 10,878,764 B2
(45) Date of Patent: Dec. 29, 2020

(54) ARRAY SUBSTRATE

(71) Applicant: LG DISPLAY CO., LTD., Seoul (KR)

(72) Inventors: Byoungwoo Kim, Seoul (KR); SangHee Yu, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/134,117

(22) Filed: Sep. 18, 2018

(65) Prior Publication Data

US 2019/0019467 A1 Jan. 17, 2019

Related U.S. Application Data

(62) Division of application No. 15/220,911, filed on Jul. 27, 2016, now Pat. No. 10,176,774.

(30) Foreign Application Priority Data

Oct. 30, 2015 (KR) ..... 10-2015-0152594

(51) Int. Cl.
*G09G 3/36* (2006.01)

(52) U.S. Cl.
CPC ..... *G09G 3/3648* (2013.01); *G09G 3/3677* (2013.01); *G09G 2300/0408* (2013.01); *G09G 2300/0426* (2013.01); *G09G 2300/0434* (2013.01); *G09G 2300/0465* (2013.01); *G09G 2310/0286* (2013.01); *G09G 2320/0209* (2013.01); *G09G 2320/0223* (2013.01)

(58) Field of Classification Search
CPC ... G09G 2300/0408; G09G 2300/0426; G09G 2300/0434; G09G 2300/0465; G09G 2310/0286; G09G 2320/0209; G09G 2320/0223; G09G 3/3648; G09G 3/3677
See application file for complete search history.

(56) References Cited

U.S. PATENT DOCUMENTS

| | | | | |
|---|---|---|---|---|
| 2006/0056267 | A1* | 3/2006 | Kim | G09G 3/3677 365/230.06 |
| 2006/0066534 | A1 | 3/2006 | Shirasaki et al. | |
| 2008/0129717 | A1 | 6/2008 | Lee et al. | |
| 2011/0043508 | A1 | 2/2011 | Han et al. | |
| 2012/0112531 | A1 | 5/2012 | Kesler et al. | |

(Continued)

FOREIGN PATENT DOCUMENTS

| | | |
|---|---|---|
| CN | 1760946 A | 4/2006 |
| CN | 1764336 A | 4/2006 |

(Continued)

OTHER PUBLICATIONS

Office Action of Chinese Patent Office in Appl'n No. 201610638716.3, dated Jun. 4, 2019.

(Continued)

*Primary Examiner* — Chun-Nan Lin
(74) *Attorney, Agent, or Firm* — Dentons US LLP

(57) ABSTRACT

An array substrate includes: a display area; a non-display area outside of the display area; a gate-in-panel (GIP) circuit in the non-display area; a plurality of clock signal lines in the non-display area and configured to transfer signals to the GIP circuit; and connection lines in the non-display area and configured to connect the plurality of clock signal lines to the GIP circuit. Each of the plurality of clock signal lines is a ring shaped line.

8 Claims, 7 Drawing Sheets

(56) References Cited

U.S. PATENT DOCUMENTS

| | | | | |
|---|---|---|---|---|
| 2012/0223927 | A1 | 9/2012 | Hsieh et al. | |
| 2013/0113688 | A1* | 5/2013 | Choi | G09G 3/3266 345/76 |
| 2015/0379955 | A1 | 12/2015 | Jeon et al. | |
| 2016/0372023 | A1* | 12/2016 | Zhang | G09G 3/2092 |

FOREIGN PATENT DOCUMENTS

| | | | |
|---|---|---|---|
| CN | 103107183 | A | 5/2013 |
| CN | 103578439 | A | 2/2014 |

OTHER PUBLICATIONS

U.S. Appl. No. 15/220,911, filed Jul. 27, 2016 (U.S. Pat. No. 10,176,774).

* cited by examiner

ARRAY SUBSTRATE

CROSS-REFERENCE TO RELATED APPLICATIONS

This application is a Divisional of application Ser. No. 15/220,911 filed on Jul. 27, 2016, which claims the priority of Korean Patent Application No. 10-2015-0152594 filed on Oct. 30, 2015, in the Korean Intellectual Property Office, the disclosure of which is incorporated herein by reference in its entirety for all purposes as if fully set forth herein.

BACKGROUND

Technical Field

The present disclosure relates to a display device having an array substrate and a method of manufacturing the same, and more specifically to an array substrate capable of reducing signal delay in clock signal lines and reducing the size of a bezel in a non-display area.

Description of the Related Art

As the era of information technology has begun, the field of display that represents electrical information signals graphically has been rapidly growing. In accordance with this, various display devices which are thinner, lighter and consume less power have been developed.

Examples of such display devices include a liquid crystal display (LCD) device, a plasma display panel (PDP) device, a field emission display (FED) device, and an organic light emitting display (OLED) device, etc.

Among these, LCD devices are most broadly employed as display devices for mobile devices in place of cathode ray tube (CRT) devices since LCD devices exhibit good quality, are light and thin and consume less power. In addition to mobile applications such as monitors of laptop computers, LCD devices are being developed for various applications such as televisions, monitors of computers, etc.

An LCD device includes a color filter array substrate on which color filters are formed, a thin-film transistor array substrate on which thin-film transistors are formed, and a liquid-crystal layer formed between the color filter array substrate and the thin-film transistor array substrate.

Among LCD devices of a variety of liquid-crystal modes, a LCD device employing horizontal electric field technology drives a liquid-crystal layer by in-plane-switching (IPS) manner by generating electric field between a pixel electrode and a common electrode disposed in parallel with a lower substrate. Such IPS-LCD devices have the advantage of wide viewing angle but have the drawback of low aperture ratio and low transmittance.

To overcome such drawbacks of IPS-LCD devices, a FFS (fringe field switching)-LCD device driven by fringe field has been proposed.

A FFS-LCD device includes a common electrode and a pixel electrode with an insulation layer therebetween in every pixel area, and fringe field in the form of an arc is generated above the common electrode and the pixel electrode. As liquid-crystal molecules disposed between upper and lower substrates are aligned by the fringe field, the aperture ratio and transmittance can be improved compared to IPS-LCD devices.

Recently, as well as requirements for light and thin display device, in order to meet the requirement for slim design of end-products such as monitors or televisions, a display device having a narrow bezel, i.e., reduced width of the non-display area surrounding the display area, especially reduced left and right bezel is in demand.

To implement such narrow bezel, the technique is employed that forms thin-film transistors (TFT) for driving pixels on the lower substrate (TFT array substrate) of an LCD device by using amorphous silicon (a-Si) and integrates a gate-in-panel (GIP) circuit working as a gate shift register into the lower array substrate of the liquid-crystal panel.

The GIP circuit is a kind of shift register and is operated sequentially by receiving clock signals via clock signal lines (CLK lines). The clock signal lines are responsible for inputting GIP signals. Delay in the input signals has to be small so as to reduce delay in output signals. If the delay in the signals increases with the load on the clock signal lines, the lifespan of the GIP circuit and the size of a buffer, i.e., a transistor included in the GIP circuit may be affected.

The RC delay in the clock signal lines may appear depending on a resistance component R and a capacitance component C. The resistance component R may be associated with the line width of the clock signal lines. The capacitance component C may be associated with capacitance between overlapping clock signal lines, and parasitic capacitance of transistors TRs using the clock signal lines.

The present inventors have recognized that in existing array substrates, in order to reduce resistance, a plurality of clock signal lines having a small line width could be arranged in the horizontal direction. In this manner, however, the size of the bezel undesirably increases. Further, overlap capacitance between the clock signal lines and between clock signal lines and connection lines connecting the clock signal lines to the GIP circuit is undesirably increased. Therefore, RC delay may not be sufficiently reduced at the cost of increased bezel.

Moreover, as the size of the bezel should be reduced in order to implement LCD devices with a more narrow bezel, the space allowed for clock signal lines becomes smaller, and thus RC delay in the clock signal lines undesirably increases.

SUMMARY

In view of the above problems recognized by the present inventors, an object of the present disclosure is to provide an array substrate for a display device, which is capable of suppressing delay in signals due to increase in load on clock signal lines inputting signal to a GIP circuit and implementing a narrow bezel by reducing the width of a non-display area on the left and right sides of a display area.

It should be noted that objects of the present disclosure are not limited to the above-described objects, and other objects of the present disclosure will be apparent to those skilled in the art from the following descriptions.

An array substrate according to an exemplary embodiment of the present disclosure includes: a display area; a non-display area outside of the display area; a gate-in-panel (GIP) circuit in the non-display area; a plurality of clock signal lines in the non-display area and configured to transfer signals to the GIP circuit; and connection lines in the non-display area and configured to connect the plurality of clock signal lines to the GIP circuit. Each of the plurality of clock signal lines is a ring shaped line.

An array substrate according to another exemplary embodiment of the present disclosure includes: a display area; a non-display area outside of the display area; a gate-in-panel (GIP) circuit in the non-display area; a first clock signal line set in the non-display area and configured to transfer signals to the GIP circuit; a second clock signal line set in the non-display area and configured to input signals to the GIP circuit; and first connection lines in the non-display area and configured to connect the first clock signal line set and the second clock signal line set to the GIP circuit. Each of the first clock signal line set and the second clock signal line set comprises first to fourth clock signal lines, respectively, and each of the first to fourth clock signal lines of the first clock signal line set is connected to each of the first to fourth clock signal lines of the second clock signal line set via second connection lines.

An array substrate according to yet another exemplary embodiment of the present disclosure includes: a gate-in-panel (GIP) circuit; a plurality of clock signal lines configured to transfer signals to the GIP circuit; and connection lines configured to connect the GIP circuit to the plurality of clock signal lines, wherein an overlapping area of the connection lines and the plurality of clock signal lines are configured to be minimized so as to reduce RC delay and implement a narrow bezel.

A gate-in-panel (GIP) circuit for a display device configured to receive clock signals for sequential operation by a shift register, the GIP circuit comprising: a structure configured to carry clock signals that reduces a load on clock signal lines by suppressing a resistance component and a capacitance component of an RC delay, and that reduces overlap capacitance between adjacent lines to implement a narrow bezel.

According to an exemplary embodiment of the present disclosure, delay in clock signal lines inputting signals to a GIP circuit can be minimized, and load on the clock signal lines can be reduced.

According to another exemplary embodiment of the present disclosure, the width of a GIP circuit in each of non-display areas on left and right sides of a display area can be reduced, thereby implementing a narrow bezel.

It should be noted that effects of the present disclosure are not limited to those described above and other effects of the present disclosure will be apparent to those skilled in the art from the following descriptions.

The Summary is not to specify essential features of the appended claims, and thus the scope of the claims is not limited thereby.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE ILLUSTRATED EMBODIMENTS

Figure 1:
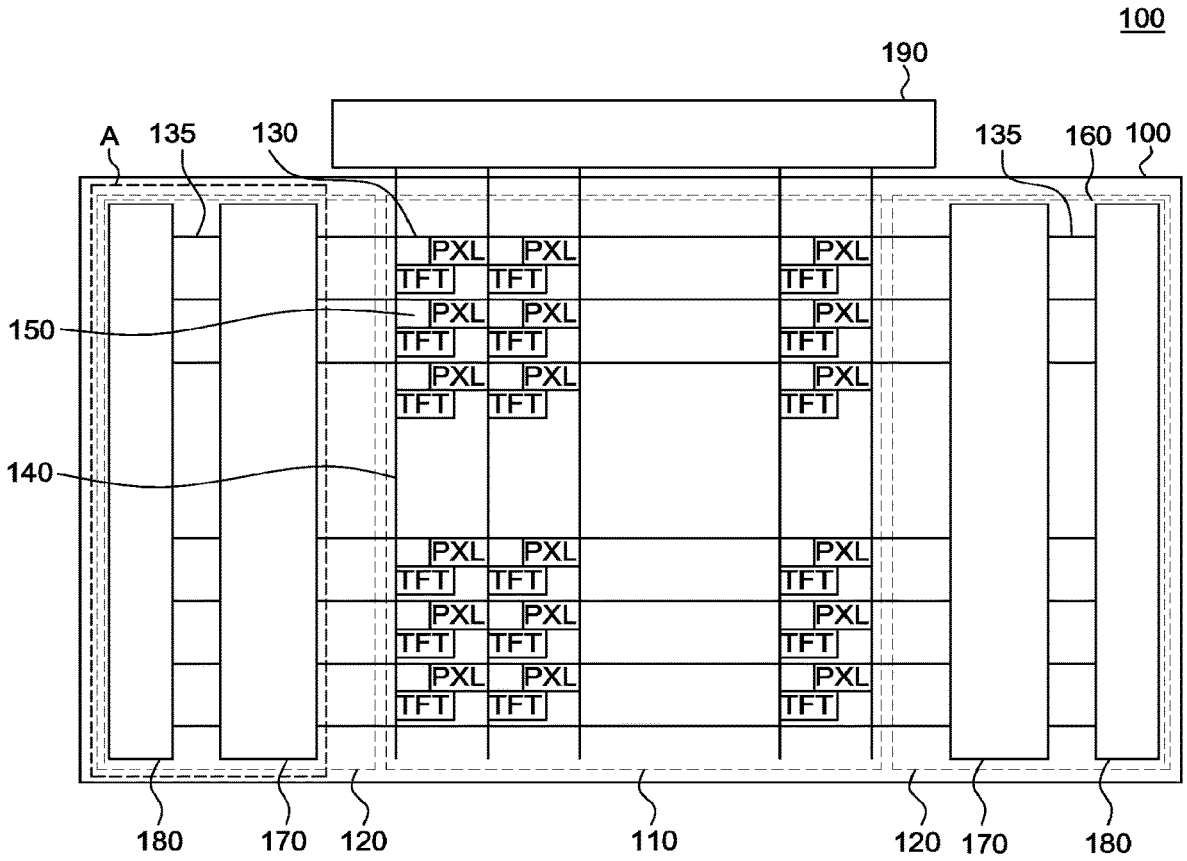
FIG. 1 is a plan view of an array substrate for LCD devices according to an exemplary embodiment of the present disclosure.

Advantages and features of the present disclosure and methods to achieve them will become apparent from the descriptions of exemplary embodiments hereinbelow with reference to the accompanying drawings. However, the present disclosure is not limited to exemplary embodiments disclosed herein but may be implemented in various different ways. The exemplary embodiments are provided for making the disclosure of the present invention thorough and for fully conveying the scope of the present invention to those skilled in the art. It is to be noted that the scope of the present disclosure is defined only by the claims.

The figures, dimensions, ratios, angles, the numbers of elements given in the drawings are merely illustrative and are not limiting. Like reference numerals denote like elements throughout the descriptions. Further, in describing the present disclosure, descriptions on well-known technologies may be omitted in order not to unnecessarily obscure the gist of the present disclosure. It is to be noticed that the terms "comprising," "having," "including" and so on, used in the description and claims, should not be interpreted as being restricted to the means listed thereafter unless specifically stated otherwise. Where an indefinite or definite article is used when referring to a singular noun, e.g. "a," "an," "the," this includes a plural of that noun unless specifically stated otherwise.

In describing elements, they are interpreted as including error margins even without explicit statements. In describing positional relationship, such as "an element A on an element B," "an element A above an element B," "an element A below an element $B_i$" and "an element A next to an element B," another element C may be disposed between the elements A and B unless the term "directly" or "immediately" is explicitly used.

As used herein, the terms first, second, etc., are used for distinguishing between similar elements and not necessarily for describing a sequential or chronological order. These terms are used to merely distinguish one element from another. Accordingly, as used herein, a first element may be a second element within the technical scope of the present disclosure.

Features of various exemplary embodiments of the present disclosure may be combined partially or totally. As will be clearly appreciated by those skilled in the art, technically various interactions and operations are possible. Various exemplary embodiments can be practiced individually or in combination.

Hereinafter, an array substrate for display devices according to exemplary embodiments of the present disclosure will be described in detail with reference to the accompanying drawings.

FIG. 1 is a plan view of an array substrate for liquid crystal display (LCD) devices according to an exemplary embodiment of the present disclosure.

As shown in FIG. 1, an array substrate 100 for LCD devices according to an exemplary embodiment of the present disclosure includes a display area 110 and non-display areas 120 disposed outside of the display area 110. The non-display areas 120 can be located on left and right sides of the display area 110, respectively.

The array substrate 100 for LCD devices according to the exemplary embodiment of the present disclosure includes gate lines 130 and data lines 140 that intersect one another and a plurality of pixel areas are defined.

In the display area 110, each of a plurality of pixel areas 150 includes a thin-film transistor (TFT) formed at intersection of the gate lines 130 and the data lines 140 and a pixel electrode PXL electrically connected to the thin-film transistor TFT.

Further, the common electrode 160 may have a plate-like shape and is formed throughout the entire surface of the array substrate 100, such that the pixel electrodes PXLs connected to the respective thin-film transistors TFTs overlap the common electrode 160.

The non-display areas 120 of the array substrate 100 according to the exemplary embodiment of the present disclosure are disposed on left and right sides of the display area 110.

Each of the non-display areas 120 may include a gate-in-panel (GIP) circuit 170 working as a gate driver as a part of the array substrate 100. The GIP circuit 170 supplies a gate signal to each of the thin-film transistors TFTs via the respective gate lines 130. The GIP circuit 170 may be disposed in each of the non-display areas 120 on the left and right sides of the display area 110, respectively.

More specifically, the GIP circuit 170 generates gate signals by using VDD, VSS, VDD select signal, Vst signal and clock signal CLK applied from external sources, and sequentially supplies the generated gate signals to the plurality of gate lines 130 formed in the display area 110 of a liquid-crystal panel.

In addition, referring to FIG. 1, a plurality of clock signal lines 180 is disposed on the left or right side of the GIP circuit 170. The clock signal lines 180 receive signals from an external data driver 190 and supply clock signals to the GIP circuit 170 to operate the GIP circuit 170 sequentially.

Connection lines 135 that electrically connect the GIP circuit 170 with the clock signal lines 180 may be disposed therebetween.

Each of the non-display areas 120 may include a dummy pixel area (or a region having non-operational pixel-like structures) between the pixel areas 150 each including the thin-film transistor TFT and the GIP circuit 170, an anti-electrostatic circuit area (or a region having elements used to reduce electrostatic effects) adjacent to the dummy pixel area, and a gate link line area (or a region having conductive lines or interconnections) adjacent to the anti-electrostatic circuit area.

The data driver 190 (or similar circuit with operation driving functions) disposed within or outside the array substrate 100 for LCD devices according to the exemplary embodiment of the present disclosure may include a timing controller T-con and a plurality of data driver ICs integrated therein. The data driver 190 is connected to pads formed in a pad area of the array substrate 100 to apply data voltage to the display area 110.

The data driver 190 generates VDD voltage, VSS voltage, VDD select signal, Vst signal and a plurality of clock signals for driving the GIP circuits 170 disposed in the left and right non-display areas of the array substrate 100 and supplies the signals to the GIP circuits 170.

Figure 2:
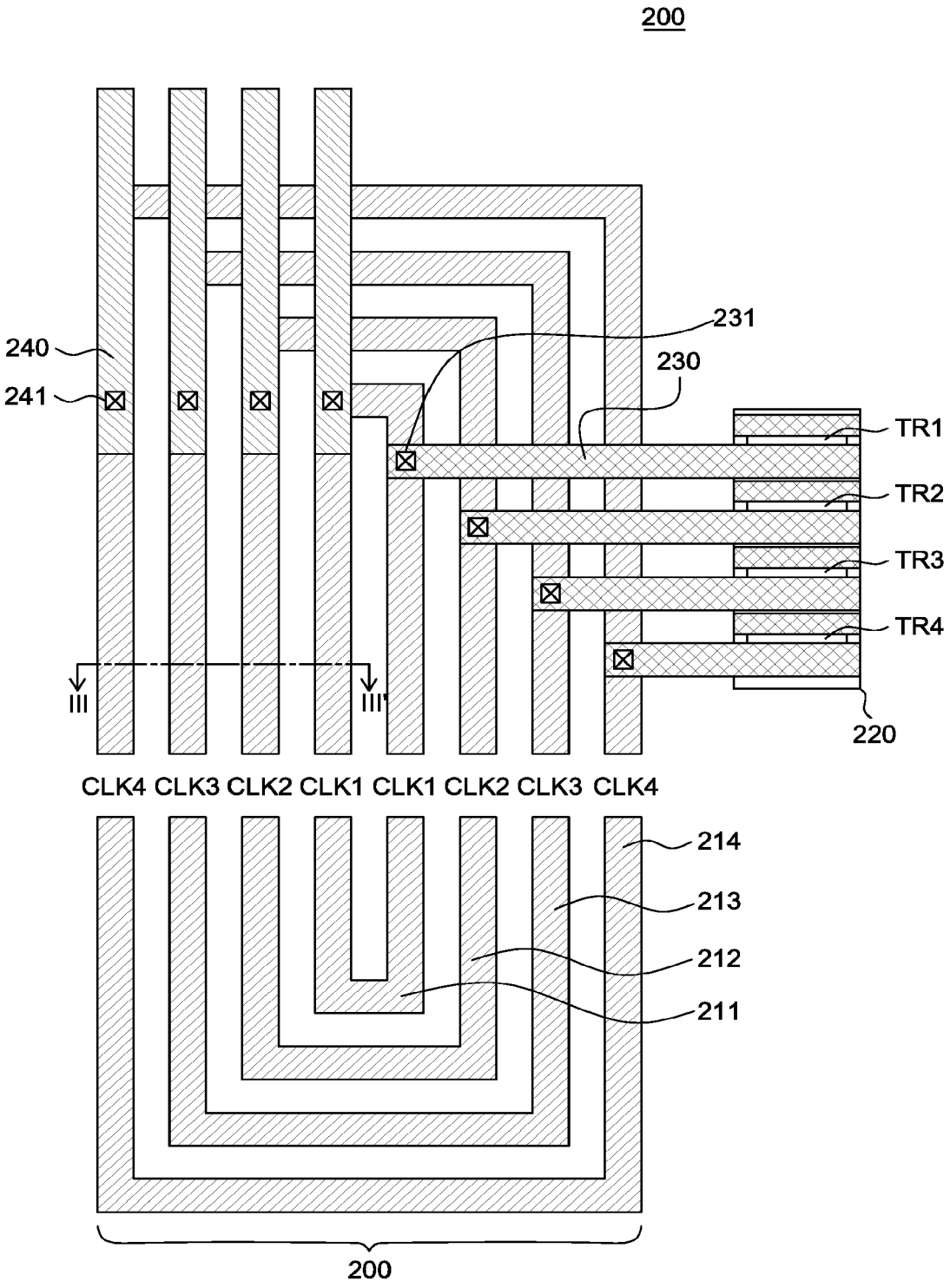
FIG. 2 is a plan view showing a structure of clock signal lines in a non-display area of an array substrate for LCD devices according to an exemplary embodiment of the present disclosure.

FIG. 2 is a plan view showing a structure of clock signal lines in a non-display area of an array substrate for LCD devices according to an exemplary embodiment of the present disclosure.

FIG. 2 is an enlarged view of portion A of the array substrate 100 shown in FIG. 1 where clock signal lines 200 according to an exemplary embodiment of the present disclosure are arranged.

The portion A in the non-display area of the array substrate 100 according to the exemplary embodiment of the present disclosure may include a GIP circuit 220, a plurality of clock signal lines 200 configured to input signals to the GIP circuit 220, connection lines 230 configured to connect the plurality of clock signal lines 200 to the GIP circuit 220, and external signal input lines 240. The GIP circuit 220 may include a plurality of transistors TR1, TR2, TR3, and TR4.

Referring to FIG. 2, the clock signal lines 200 may include a plurality of lines each supplying different signals, e.g., a first clock signal line (CLK1) 211, a second clock signal line (CLK2) 212, a third clock signal line (CLK3) 213, and a fourth clock signal line (CLK4) 214.

Although the clock signal lines 200 of the array substrate 100 according to the exemplary embodiment of the present disclosure include four clock signal lines, i.e., the first to fourth clock signal lines 211, 212, 213 and 214 as shown in FIG. 2 for convenience of illustration only, and more than four clock signal lines may be disposed in other implementations.

In addition, referring to FIG. 2, each of the first clock signal line (CLK1) 211, the second clock signal line (CLK2) 212, the third clock signal line (CLK3) 213 and the fourth clock signal line (CLK) 214 may be a ring shaped line with four sides.

In addition, referring to FIG. 2, the fourth clock signal line 214 surrounds (e.g. partially or mostly encompasses) the third clock signal line 213, the third clock signal line 213 surrounds (e.g. partially or mostly encompasses) the second clock signal line 212, and the second clock signal line 212 surrounds (e.g. partially or mostly encompasses) the first clock signal line 211.

That is, the clock signal lines 200 according to the exemplary embodiment may include the first to fourth clock signal lines 211, 212, 213 and 214 arranged in concentric square rings or some other similar configuration.

In addition, referring to FIG. 2, the connection lines 230 may overlap parts of the first to fourth clock signal lines 211, 212, 213 and 214. The connection lines 230 are configured to connect the first to fourth clock signal lines 211, 212, 213 and 214 to the GIP circuit 220 via contact holes 231 disposed on the first to fourth clock signal lines 211, 212, 213 and 214.

In addition, referring to FIG. 2, the external signal input lines 240 may be connected to the first to fourth clock signal lines 211, 212, 213 and 214 via contact holes 241 formed therein, respectively, such that clock signals input from external sources may be transferred to the first to fourth clock signal lines 211, 212, 213 and 214.

The first to fourth clock signal lines 211, 212, 213 and 214 may further include auxiliary clock signal lines, which may not overlap the connection lines 230. The auxiliary signal lines may be disposed on the ring shaped lines or under the ring shaped lines. By employing such auxiliary clock signal lines, the resistance of the first to fourth clock signal lines 211, 212, 213 and 214 can be further reduced.

In existing array substrates, clock signal lines are arranged in the horizontal direction, such that the size of the bezel is increased. In addition, overlap capacitance is increased between the clock signal lines and between the clock signal lines and connection lines connecting the clock signal lines to the GIP circuit, and thus it is difficult to reduce RC delay.

Moreover, as the size of the bezel becomes smaller in order to implement LCD devices with a narrow bezel, the space allowed for clock signal lines becomes smaller, and thus RC delay in the clock signal lines increases.

In contrast, according to the exemplary embodiment of the present disclosure, the clock signal lines 200 includes first to fourth clock signal lines 211, 212, 213 and 214 arranged in concentric square rings (or other shapes and configurations that achieve the same or similar effects), each of which is a ring shaped line with four sides. Accordingly, the number of portions where the connection lines 230 overlap the first to fourth clock signal lines 211, 212, 213 and 214 can be reduced, and thus overlap capacitance can be minimized. As a result, load on the clock signal lines 200 may be reduced, and RC delay can be minimized. Moreover, the width of the clock signal lines 200 can be reduced compared to existing array substrates in which several clock signal lines are arranged in horizontal direction, such that narrow bezel can be implemented.

Figure 3:
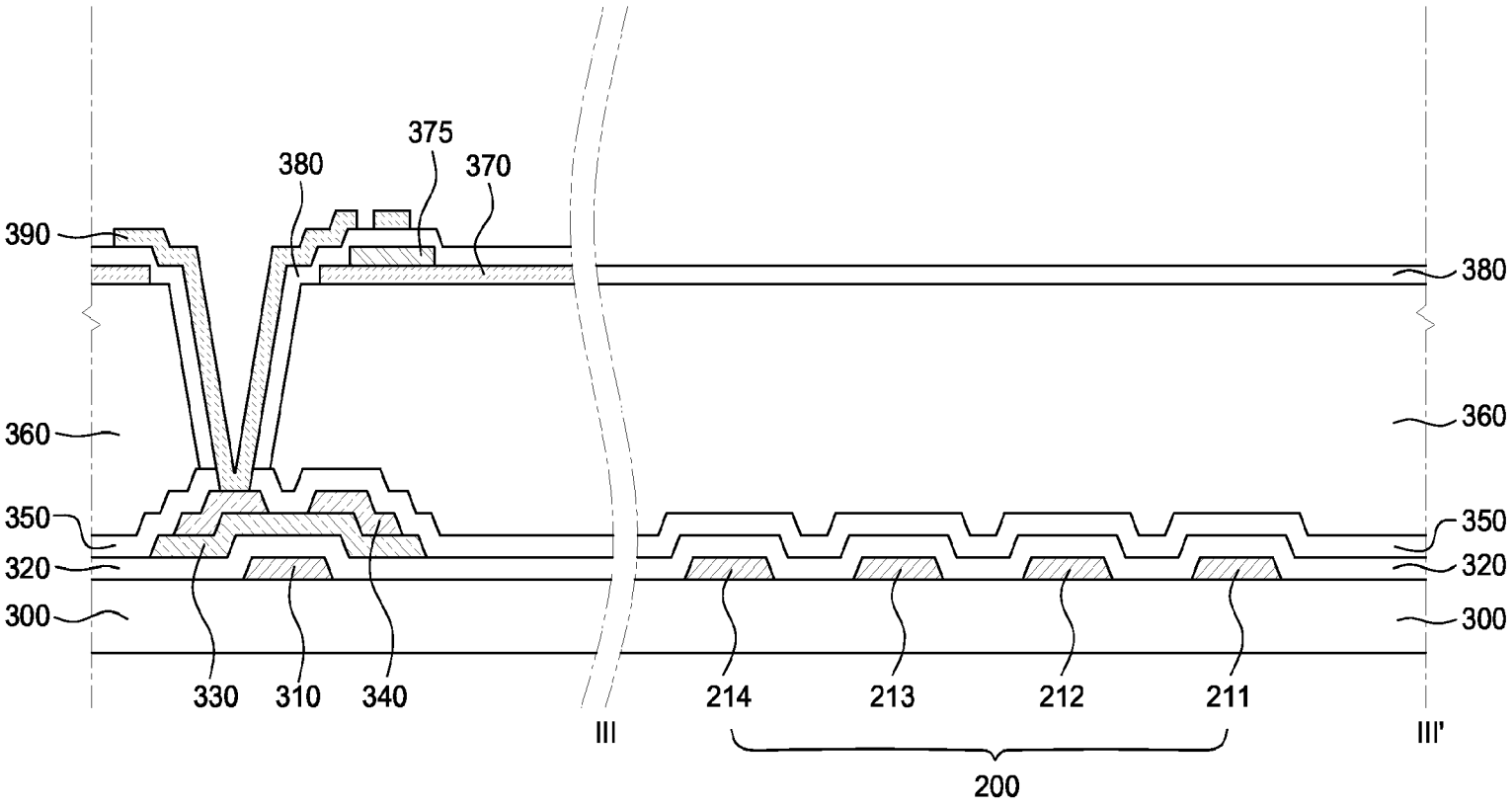
FIG. 3 is a cross-sectional view of a thin film transistor in a display area and clock signal lines in a non-display area of an array substrate for LCD devices according to an exemplary embodiment of the present disclosure.

FIG. 3 is a cross-sectional view of a thin film transistor in a display area and clock signal lines in a non-display area of an array substrate for LCD devices according to an exemplary embodiment of the present disclosure.

That is, FIG. 3 shows a cross-sectional structure of the thin-film transistor TFT in the pixel area 150 of the array substrate according to the exemplary embodiment described above with reference to FIG. 1, and a cross section structure of the clock signal lines 200 described above with reference to FIG. 2, taken along line III-III'.

The cross-sectional structure of the thin-film transistor of the array substrate 100 for FFS-LCD devices and the clock signal lines 200 in the non-display area 120 according to the exemplary embodiment of the present disclosure will be described in detail with reference to FIG. 3.

Referring to FIG. 3, a gate electrode 310 is formed on a substrate 300 in the display area 110. The gate electrode 310 branches off from a gate line extended in a first direction, i.e., the horizontal direction of the substrate 300 such that it is disposed in each of pixel areas. In addition, first to fourth clock signal lines 211, 212, 213 and 214 are formed on the substrate 300 in the non-display area 120.

A gate insulation layer 320 may be formed on the entire surface of the substrate 300 where the gate electrode 310 is formed in the display area 110 such that it covers the gate electrode 310. In addition, at the same time, the gate insulation layer 320 may also be formed on the first to fourth clock signal lines 211, 212, 231 and 214 in the non-display area 120.

A semiconductor layer 330 is formed on the gate insulation layer 320 in the display area 110 such that it overlaps at least a part of the gate electrode 310.

The semiconductor layer 330 may be made of at least one of amorphous silicon, poly crystalline silicon, and metal oxide such as indium gallium zinc oxide (IGZO), zinc tin oxide (ZTO) or zinc indium oxide (ZIO), etc. or combinations thereof.

Source and drain electrodes 340 are formed on both sides of the semiconductor layer 330 in the display area 110, respectively, such that they partially overlap the semiconductor layer 330 and are spaced apart from each other. The source electrode 340 branches off from the data lines extended on the gate insulation layer 320 in a second direction perpendicular to the first direction in each of the pixel areas.

The source and drain electrodes 340 may be patterned together with the semiconductor layer 330 formed on the gate insulation layer 320 by using a half tone mask (or some other mask or element achieving similar effects), such that they may be formed in a single mask process.

A first passivation layer 350 (or some other functional layer achieving similar effects) is formed on the gate insulation layer 320 in the display area 110 of the thin-film transistor of the FFS-LCD device included in the pixel area of the array substrate 100 according to the exemplary embodiment, such that it covers the semiconductor layer 330 and the source and drain electrodes 340. The first passivation layer 350 has a contact hole via which a part of the drain electrode thereunder is exposed. In addition, at the same time, the first passivation layer 350 is also formed on the gate insulation layer 320 in a portion of the non-display area 120 where gate link lines are disposed.

A planarization layer 360 (or some other functional layer achieving similar effects) is formed on the first passivation layer 350, which is made of an organic insulative material having a relatively flat surface, such as photo-acryl. The planarization layer 360 includes a contact hole via which a part of the drain electrode is exposed. In addition, the planarization layer 360 is also formed on the first passivation layer 350 in the portion of the non-display area 120 where the gate link lines are disposed.

A common electrode 370 (or some other conductive layer achieving similar effects) is formed on the planarization layer 360. The common electrode 370 is made of a transparent, conductive material such as indium tin oxide (ITO) and may be formed on the entire surface of the substrate 300.

A third conductive layer 375 (or some other functional layer achieving similar effects) is formed on the common electrode 370. The third conductive layer 375 may have a lattice pattern so as to reduce deviation in resistance of the common electrode 370 and may be made of low resistance metal material such as copper (Cu). In addition, the third conductive layer 375 may be made of at least one of aluminum (Al), molybdenum (Mo) and multiple layers including aluminum (Al) and molybdenum (Mo), or some other single or multiple layer structure of conductive materials.

A second passivation layer 380 (or some other functional layer achieving similar effects) is formed on the common electrode 370 and the third conductive layer 375. The second passivation layer 380 includes a contact hole via which a part of the drain electrode is exposed. Further, the second passivation layer 380 may be also formed on the planarization layer 360 in the non-display area 120.

A pixel electrode 390 (or some other functional layer achieving similar effects) is formed on the second passivation layer 380. The pixel electrode 390 is connected to the source and drain electrodes 340 via a contact hole formed through the first passivation layer 350, the planarization layer 360 and the second passivation layer 380.

Although the plurality of clock signal lines 200 of the array substrate 100 according to the exemplary embodiment, i.e., the first to fourth clock signal lines 211, 212, 213 and 214 are formed in the same layer (i.e. formed at the same cross-sectional level) and made of the same material as the gate electrode 310 in FIG. 3, this is merely illustrative. For example, the plurality of clock signal lines 200 may be formed in the same layer and made of the same material as at least one selected from the gate electrode 310, the source and drain electrodes 340 and the third conductive layer 375 disposed in the layer different from the layer where the gate electrode 310 and the source and drain electrodes 340 are disposed.

Figure 4:
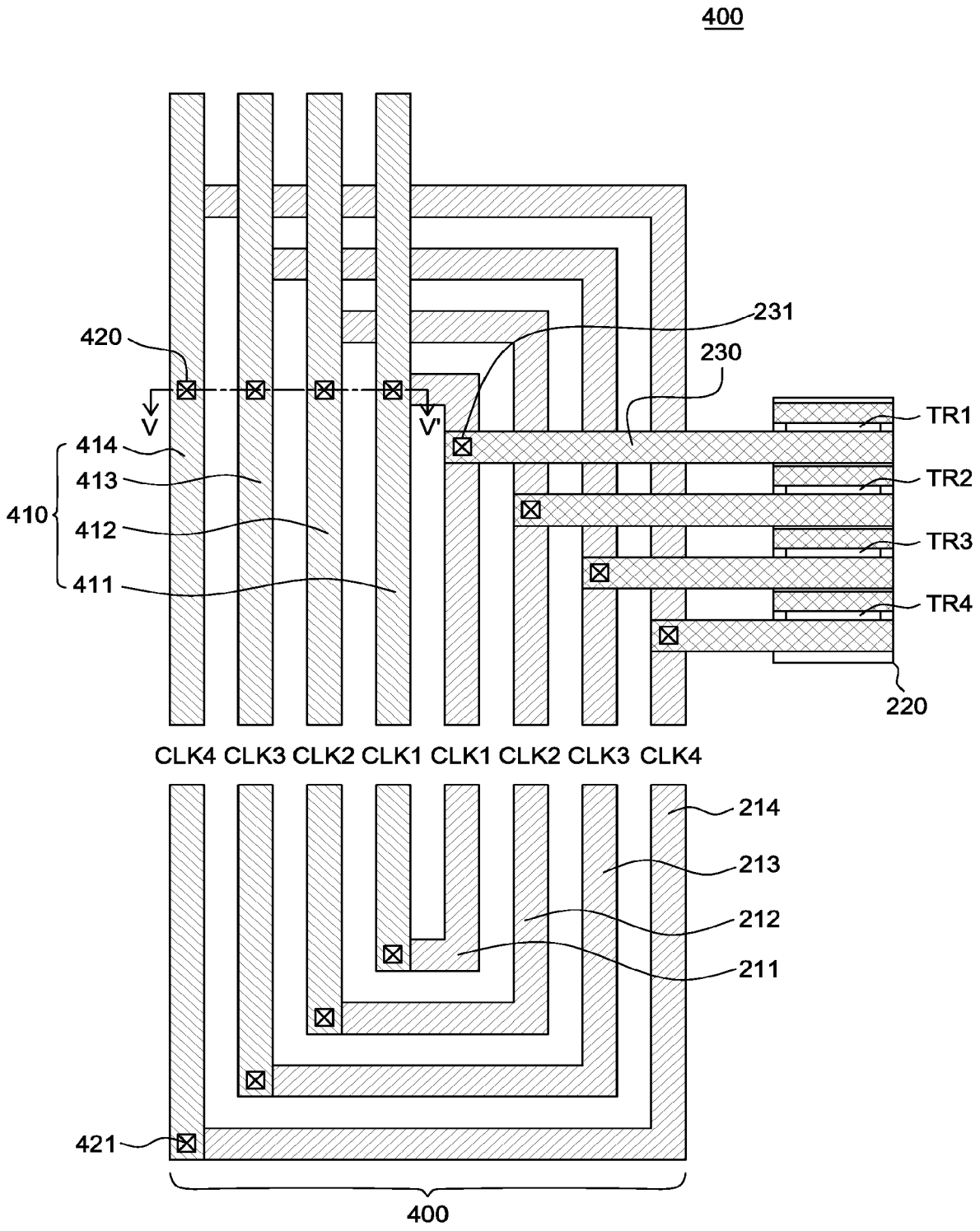
FIG. 4 is a plan view showing an arrangement of clock signal lines in a non-display area of an array substrate for LCD devices according to another exemplary embodiment of the present disclosure.

FIG. 4 is a plan view showing a structure of clock signal lines in a non-display area of an array substrate for LCD devices according to another exemplary embodiment of the present disclosure.

FIG. 4 is an enlarged view of portion A of the array substrate 100 shown in FIG. 1 where clock signal lines 400 according to another exemplary embodiment of the present disclosure are arranged.

Figure 5:
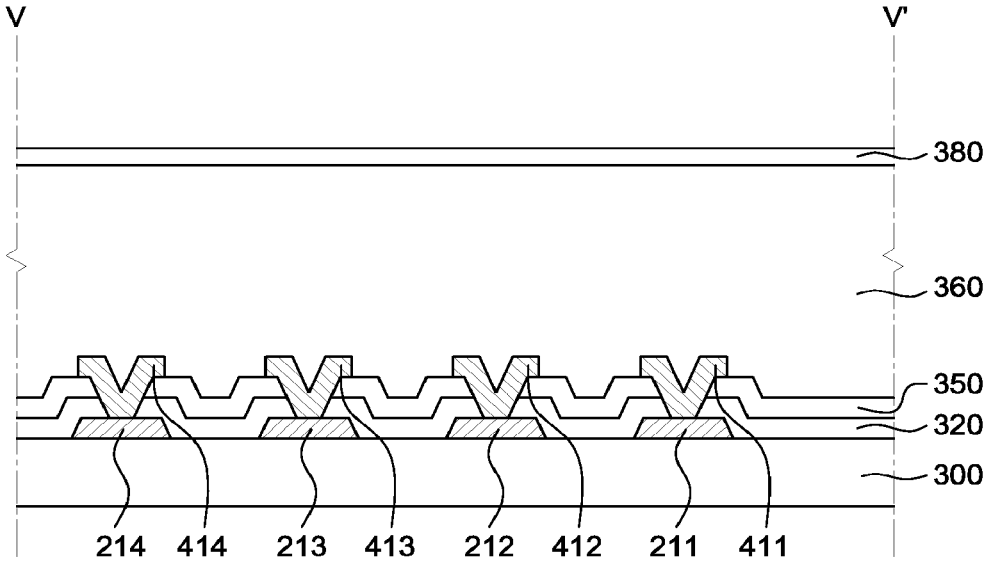
FIG. 5 is a cross-sectional view showing a structure of clock signal lines in a non-display area of an array substrate for LCD devices according to another exemplary embodiment of the present disclosure.

FIG. 5 is a view showing cross-sectional structure of clock signal lines 400 in a non-display area of an array substrate for LCD devices according to another exemplary embodiment of the present disclosure. That is, FIG. 5 is a cross-sectional view of the clock signal lines 400 taken along line V-V' of FIG. 4.

In describing the array substrate for LCD devices according to this exemplary embodiment, the redundant description on the identical functions and elements will be omitted, despite such functions and elements being part of this exemplary embodiment.

The portion A in the non-display area of the array substrate 100 according to the exemplary embodiment of the present disclosure may include a GIP circuit 220, a plurality of clock signal lines 400 configured to input signals to the GIP circuit 220, and connection lines 230 configured to connect the plurality of clock signal lines 400 to the GIP circuit 220. The GIP circuit 220 may include a plurality of transistors TR1, TR2, TR3, and TR4.

Referring to FIG. 4, the clock signal lines 400 may include a plurality of lines each supplying different signals, e.g., a first clock signal line (CLK1) 211, a second clock signal line (CLK2) 212, a third clock signal line (CLK3) 213, and a fourth clock signal line (CLK4) 214.

Although the clock signal lines 400 of the array substrate 100 according to the exemplary embodiment of the present disclosure include four clock signal lines, i.e., the first, second, third and fourth clock signal lines 211, 212, 213 and 214 as shown in FIG. 4 for convenience of illustration, more than four clock signal lines may be disposed in other implementations or modifications.

Each of the first clock signal line (CLK1) 211, the second clock signal line (CLK2) 212, the third clock signal line (CLK3) 213 and the fourth clock signal line (CLK) 214 may be a ring shaped line having four sides.

The fourth clock signal line 214 surrounds the third clock signal line 213, the third clock signal line 213 surrounds the second clock signal line 212, and the second clock signal line 212 surrounds the first clock signal line 211.

Referring to FIG. 4, the clock signal lines 400 of the array substrate 100 according to the exemplary embodiment of the present disclosure may further include additional clock signal lines 410 including fifth to eighth clock signal lines 411, 412, 413 and 414 each disposed on a part of at least one side of the respective first to fourth clock signal lines 211, 212, 213 and 214.

Referring to FIGS. 4 and 5, the first to fourth clock signal lines 211, 212, 213 and 214 may be connected to the fifth to eighth clock signal lines 411, 412, 413 and 414, respectively, via at least two contact holes 420 and 421.

That is, referring to FIG. 5, the first to fourth clock signal lines 211, 212, 213 and 214 may be electrically connected to the fifth to eighth clock signal lines 411, 412, 413 and 414 disposed on the first to fourth clock signal lines 211, 212, 213 and 214, respectively, via the contact holes formed through the gate insulation layer 320 and the first passivation layer 350.

For example, the fifth to eighth clock signal lines 411, 412, 413 and 414 of the clock signal lines 400 may be formed in the same layer (i.e. at the same cross-section level) and made of the same material as that of at least one selected from the gate electrode 310, the source and drain electrodes 340 and the third conductive layer 375 disposed in the layer different from the layer where the gate electrode 310 and the source and drain electrodes 340 are disposed shown in FIG. 3.

As such, by further disposing the fifth to eight signal lines 411, 412, 413 and 414 above the first to fourth clock signal lines 211, 212, 213 and 214, respectively, a particular multi-level structure in cross section is implemented, such that resistance on the first to fourth signal lines 211, 212, 213 and 214 can be further reduced.

The first to fourth clock signal lines 211, 212, 213 and 214 may further include auxiliary clock signal lines, which may not overlap the connection lines 230. The auxiliary clock signal lines may be disposed on the ring shaped lines or under the ring shaped lines. By employing such auxiliary clock signal lines, the resistance of the first to fourth clock signal lines 211, 212, 213 and 214 can be further reduced.

Further, referring to FIG. 4, at least one among the fifth to eighth clock signal lines 411, 412, 413 and 414 may be extended out of the array substrate 100 and may work as external input lines or serve an interconnection function. In addition, the fifth to eighth clock signal lines 411, 412, 413 and 414 may transfer clock signals input from an external source to the first to fourth clock signal lines 211, 212, 213 and 214.

That is, the clock signal lines 400 according to the exemplary embodiment of the present disclosure can reduce the resistance of the first to fourth clock signal lines 411, 412, 413 and 414 compared to the structure of existing clock signal lines by way of further disposing the fifth to the eighth clock signal lines 411, 412, 413 and 414 on the first to fourth clock signal lines 211, 212, 213 and 214, respectively, to implement multi-level structure, such that load on the clock signal lines 400 can be reduced and RC delay can be minimized. Moreover, the width of the clock signal lines 400 can be reduced compared to existing array substrates in which several clock signal lines are arranged in horizontal (i.e. row) direction, such that narrow bezel configurations can be implemented.

Figure 6:
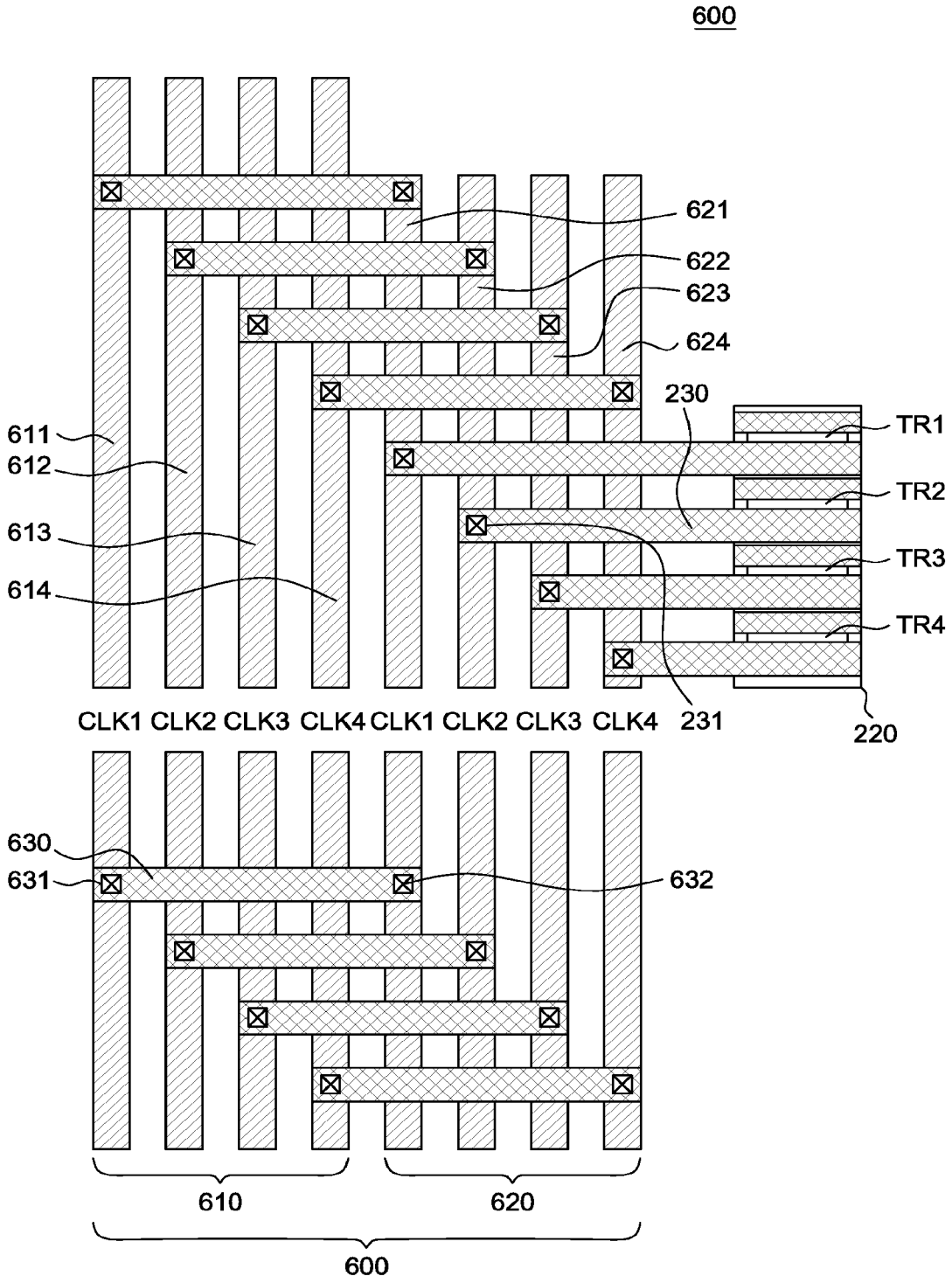
FIG. 6 is a plan view showing an arrangement of clock signal lines in a non-display area of an array substrate for LCD devices according to yet another exemplary embodiment of the present disclosure.

FIG. 6 is a plan view showing a structure of clock signal lines in a non-display area of an array substrate for LCD devices according to yet another exemplary embodiment of the present disclosure.

In describing the array substrate for LCD devices according to this exemplary embodiment, the redundant description on the identical functions and elements will be omitted, despite such functions and elements being part of this exemplary embodiment.

The portion A in the non-display area of the array substrate 100 according to the exemplary embodiment of the present disclosure may include a GIP circuit 220, a plurality of clock signal lines 600 configured to input signals to the GIP circuit 220, and first connection lines 230 configured to connect the plurality of clock signal lines 600 to the GIP circuit 220. The GIP circuit 220 may include a plurality of transistors TR1, TR2, TR3, and TR4.

Referring to FIG. 6, the clock signal lines 600 according to the exemplary embodiment may include a first clock signal line set 610 and a second clock signal line set 620.

The first clock signal line set 610 and the second clock signal line set 620 may be adjacent to each other in the horizontal (i.e. row) direction.

The first clock signal line set 610 may include a set or group of signal lines, such as first to fourth clock signal lines 611, 612, 613 and 614. The second clock signal line set 620 may include a set or group of signal lines, such as first to fourth clock signal lines 621, 622, 623 and 624. The first to fourth clock signal lines 611, 612, 613 and 614 of the first clock signal line set 610 may be connected to the first to fourth clock signal lines 621, 622, 623 and 624 of the second clock signal line set 620, respectively, via second connection lines 630.

More specifically, the second connection lines 630 may connect the first to fourth clock signal lines 611, 612, 613 and 614 of the first clock signal line set 610 to the first to fourth clock signal lines 621, 622, 623 and 624 of the second clock signal line set 620, respectively, via contact holes 631 formed above the first to fourth clock signal lines 611, 612, 613 and 614 of the first clock signal line set 610 and via contact holes 632 formed above the first to fourth clock signal lines 621, 622, 623 and 624 of the second clock signal line set 620.

That is, some of the plurality of clock signal lines 600 which input, carry or transfer the same clock signals to the GIP circuit 220 may be connected to one another via the second connection lines 630. In this manner, the resistance on the first to fourth clock signal lines 611, 612, 613 and 614 of the first clock signal line set 610 and resistance on the first to fourth clock signal lines 621, 622, 623 and 624 of the second clock signal line set 620 can be reduced compared to the structure of existing clock signal lines.

The second connection lines 630, which connect the first to fourth clock signal lines 611, 612, 613 and 614 of the first clock signal line set 610 to the first to fourth clock signal lines 621, 622, 623 and 624 of the second clock signal line set 620, respectively, may include at least two lines.

Although the clock signal lines 600 of the array substrate 100 according to the exemplary embodiment of the present disclosure include four clock signal lines, i.e., the first, second, third and fourth clock signal lines CLK1, CLK2, CLK3 and CLK4 as shown in FIG. 6 for convenience of illustration, more than four clock signal lines may be disposed in other implementations or modifications.

The second connection lines 630 may be formed in the same layer and made of the same material as the first connection lines 230 configured to connect the clock signal lines 600 to the GIP circuit 220.

The clock signal lines 600 according to the exemplary embodiment of the present disclosure can reduce the resistance on the first to fourth clock signal lines 611, 612, 613 and 614 of the first clock signal line set 610 and the resistance on the first to fourth clock signal lines 621, 622, 623 and 624 of the second clock signal line set 620 compared to the structure of existing clock signal lines, such that load on the clock signal lines 600 can be reduced and RC delay can be minimized. Moreover, the width of the clock signal lines 600 can be reduced compared to existing array substrates in which several clock signal lines are arranged in horizontal (i.e. row) direction, such that narrow bezel can be implemented.

Figure 7:
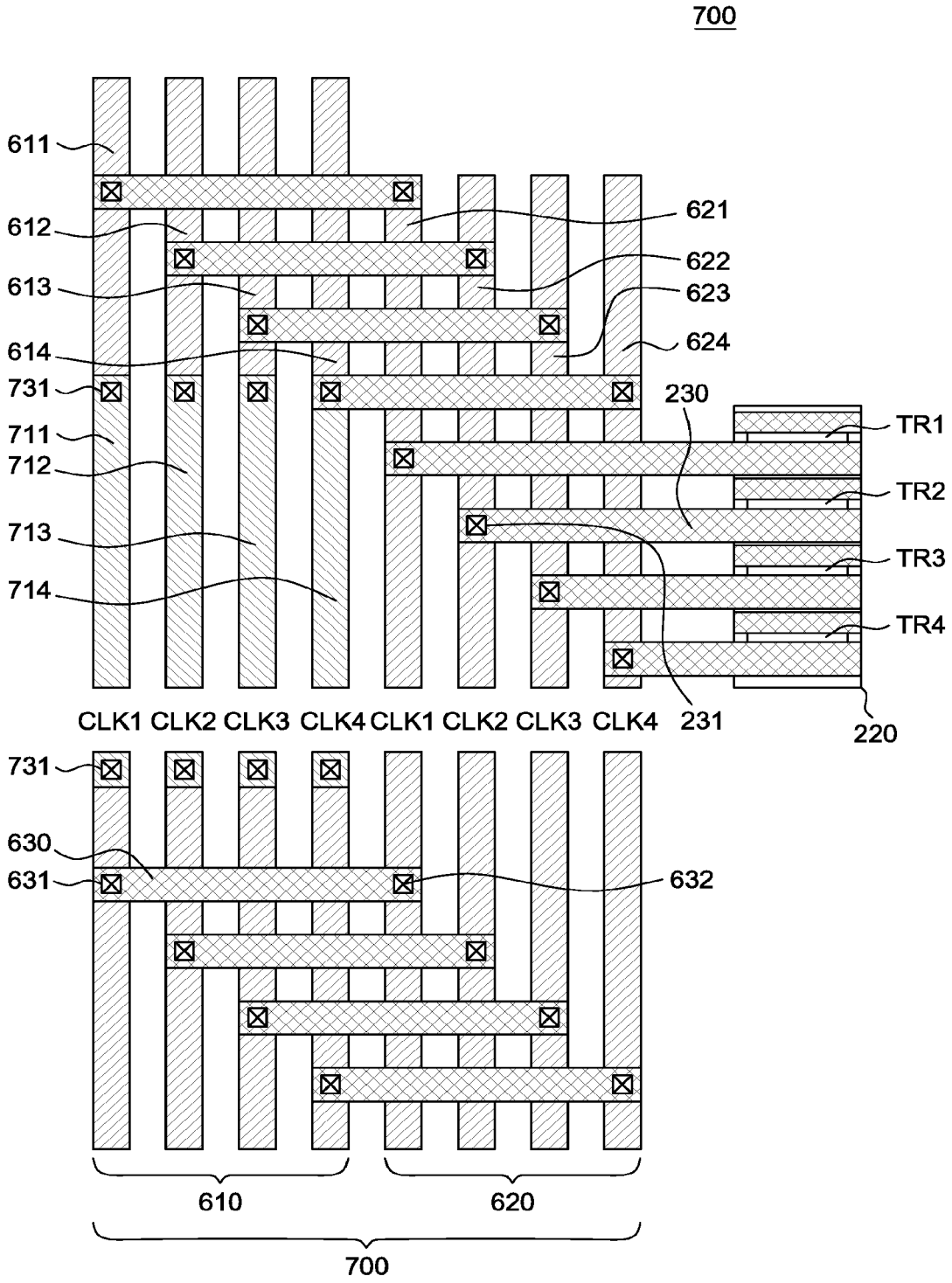
FIG. 7 is a plan view showing an arrangement of clock signal lines in a non-display area of an array substrate for LCD devices according to yet another exemplary embodiment of the present disclosure.

FIG. 7 is a plan view showing a structure of clock signal lines in a non-display area of an array substrate for LCD devices according to yet another exemplary embodiment of the present disclosure.

In describing the array substrate for LCD devices according to this exemplary embodiment, the redundant description on the identical functions and elements will be omitted, despite such functions and elements being part of this exemplary embodiment.

The portion A in the non-display area of the array substrate 100 according to the exemplary embodiment of the present disclosure may include a GIP circuit 220, a plurality of clock signal lines 700 configured to input signals to the GIP circuit 220, and first connection lines 230 configured to connect the plurality of clock signal lines 700 to the GIP circuit 220.

Referring to FIG. 7, the clock signal lines 700 according to the exemplary embodiment may include a first clock signal line set 610 and a second clock signal line set 620. The first clock signal line set 610 and the second clock signal line set 620 may be adjacent to each other in the horizontal direction.

The first clock signal line set 610 may include a set or group of lines, such as first to fourth clock signal lines 611, 612, 613 and 614. The second clock signal line set 620 may include a set or group of lines, such as first to fourth clock signal lines 621, 622, 623 and 624. The first to fourth clock signal lines 611, 612, 613 and 614 of the first clock signal line set 610 may be connected to the first to fourth clock signal lines 621, 622, 623 and 624 of the second clock signal line set 620, respectively, via second connection lines 630.

In addition, referring to FIG. 7, the clock signal lines 700 may further include fifth to eighth clock signal lines 711, 712, 713 and 714, each disposed on a part of the respective one of the first to fourth clock signal lines 611, 612, 613 and 614 of the first clock signal line set 610 or the first to fourth clock signal lines 621, 622, 623 and 624 of the second clock signal line set 620 and connected to the respective one of the first to fourth clock signal lines 611, 612, 613 and 614 or 621, 622, 623 and 624, respectively, via at least two contact holes 731 thereabove.

The fifth to eighth clock signal lines 711, 712, 713 and 714 may be formed in the same layer (i.e. same cross-sectional level) and made of the same material as that of the first connection lines 230 configured to connect the first to fourth clock signal lines 611, 612, 613 and 614 or 621, 622, 623 and 624 to the GIP circuit 220.

The clock signal lines 700 according to the exemplary embodiment of the present disclosure may further include auxiliary clock signal lines 711, 712, 713 and 714 disposed to be connect to the clock signal lines via the contact holes 731 above the plurality of clock signal lines 611, 612, 613 and 614 or 621, 622, 623 and 624. In this manner, the resistance on the first to fourth clock signal lines 611, 612, 613 and 614 of the first clock signal line set 610 and resistance on the first to fourth clock signal lines 621, 622, 623 and 624 of the second clock signal line set 620 can be further reduced compared to the structure of existing clock signal lines.

That is, by further disposing the fifth to eighth clock signal lines 711, 712, 713 and 714 above the first to fourth clock signal lines 611, 612, 613 and 614 of the first clock signal line set 610 or above the first to fourth clock signal lines 621, 622, 623 and 624 of the second clock signal line set 620, the clock signal lines 700 according to the exemplary embodiment of the present disclosure can reduce the resistance compared to the structure of existing clock signal lines, such that load on the clock signal lines 700 can be reduced and RC delay can be minimized. Moreover, the width of the clock signal lines 700 can be reduced compared to existing array substrates in which several clock signal lines are arranged in horizontal (i.e. row) direction, such that narrow bezel can be implemented.

As described above, the array substrate according to the exemplary embodiments of the present disclosure has a particular inventive structure of clock signal lines that reduces capacitance generated as connection lines for connecting a GIP circuit to the plurality of clock signal lines overlap the clock signal lines. In addition, in the special structure, the clock signal lines are specifically arranged in multiple levels in cross section, such that the resistance is reduced. As a result, RC delay in the clock signal lines can be minimized. In addition, the width of the clock signal lines is reduced, and thus a narrow bezel can be implemented.

The exemplary embodiments of the present disclosure can also be described as follows:

According to an aspect of the present disclosure, an array substrate includes: a display area; a non-display area outside of the display area; a gate-in-panel (GIP) circuit in the non-display area; a plurality of clock signal lines in the non-display area and configured to transfer signals to the GIP circuit; and connection lines in the non-display area and configured to connect the plurality of clock signal lines to the GIP circuit. Each of the plurality of clock signal lines is a ring shaped line with four sides.

The plurality of clock signal lines may include a first clock signal line, a second clock signal line, a third clock signal line and a fourth clock signal line, and the fourth clock signal line substantially surrounds the third clock signal line, the third clock signal line substantially surrounds the second clock signal line, and the second clock signal line substantially surrounds the first clock signal line.

The plurality of clock signal lines may further include: a fifth clock signal line on at least one side of a respective one of the first to fourth clock signal lines; a sixth clock signal line on at least one side of a respective one of the first to fourth clock signal lines; a seventh clock signal line on at least one side of a respective one of the first to fourth clock signal lines; and an eighth clock signal line on at least one side of a respective one of the first to fourth clock signal lines.

Each of the first to fourth clock signal lines may be connected to each of the fifth to eighth clock signal lines, respectively, via at least two contact holes.

The fifth to eighth clock signal lines may be configured to work as external signal input lines.

Each of the first to fourth signal lines may include an auxiliary clock signal line connected to the ring shaped line.

The first to fourth clock signal lines may be formed in the same layer or cross-sectional level and made of the same material as that of at least one among a gate electrode, source and drain electrodes, and a third conductive layer disposed in a layer different from a layer in which the source and drain electrodes are disposed.

The fifth to eighth clock signal lines may be formed in the same layer or cross-sectional level and made of the same material as that of one among a gate electrode, source and drain electrodes, and a third conductive layer disposed in a layer different from a layer in which the source and drain electrodes are disposed.

The connection lines may be configured to connect the plurality of clock signal lines to the GIP circuit via contact holes each disposed on the respective clock signal lines.

According to another aspect of the present disclosure, an array substrate includes: a display area; a non-display area outside of the display area; a gate-in-panel (GIP) circuit in the non-display area; a first clock signal line set in the non-display area and configured to transfer signals to the GIP circuit; a second clock signal line set in the non-display area and configured to input signals to the GIP circuit; and first connection lines in the non-display area and configured to connect the first clock signal line set and the second clock signal line set to the GIP circuit. Each of the first clock signal line set and the second clock signal line set comprises first to fourth clock signal lines, and the first to fourth clock signal lines of the first clock signal line set are connected to the first to fourth clock signal lines of the second clock signal line set, respectively, via second connection lines.

The first clock signal line set may be adjacent to the second clock signal line set in a horizontal or row direction.

The second connection lines may connect the first to fourth clock signal lines of the first clock signal line set to the first to fourth clock signal lines of the second clock signal line set, respectively, via contact holes formed above the first to fourth clock signal lines of the first clock signal line set and via contact holes formed above the first to fourth clock signal lines of the second clock signal line set.

The array substrate may further include: fifth to eighth clock signal lines disposed above the first to fourth clock signal lines of the first or second clock signal line set, wherein the fifth to eighth clock signal lines are connected to the first to fourth clock signal lines of the first or second clock signal line set, respectively, via contact holes formed above the first to fourth clock signal lines.

The fifth to eighth clock signal lines may be in the same layer and made of the same material as that of the first connection lines.

The second connection lines may include at least two lines.

The first connection lines and the second connection lines may be in the same layer or cross-sectional level, and formed of the same material.

According to yet another aspect of the present disclosure, an array substrate includes: a gate-in-panel (GIP) circuit; a plurality of clock signal lines configured to transfer signals to the GIP circuit; and connection lines configured to connect the GIP circuit to the plurality of clock signal lines, wherein an overlapping area of the connection lines and the plurality of clock signal lines are configured to be minimized so as to reduce RC delay and implement a narrow bezel.

Each of the plurality of clock signal lines may have a ring shaped line with four sides.

Each of the plurality of clock signal lines may further include an auxiliary clock signal line configured to be connected to the respective clock signal lines via a contact hole thereabove.

Some of the plurality of clock signal lines that transfer the same signal to the GIP circuit may be connected to one another via the connection lines.

According to an aspect of the present disclosure, a gate-in-panel (GIP) circuit for a display device configured to receive clock signals for sequential operation by a shift register, the GIP circuit comprising: a structure configured to carry clock signals that reduces a load on clock signal lines by suppressing a resistance component and a capacitance component of an RC delay, and that reduces overlap capacitance between adjacent lines to implement a narrow bezel.

The structure may include clock signal lines arranged in concentric square rings.

A part of the structure of clock signal lines may comprise clock signal lines arranged in multiple cross sectional levels.

A connection line connecting the clock signal lines with each other may be formed of a material different from a material of the clock signal lines.

A part of the structure may comprise clock signal lines arranged in multiple cross sectional levels.

While particular embodiments of the present disclosure have been disclosed, it is to be understood that various different modifications and combinations are possible without departing from the gist of the present disclosure by those skilled in the art. Accordingly, the exemplary embodiments described herein are merely illustrative and are not intended to limit the scope of the present disclosure. The technical idea of the present disclosure is not limited by the exemplary embodiments. The scope of protection sought by the present disclosure is defined by the appended claims and all equivalents thereof are construed to be within the true scope of the present disclosure.

What is claimed is:

1. An array substrate for display devices comprising:

a gate-in-panel (GIP) circuit;

a plurality of clock signal lines configured to transfer signals to the GIP circuit; and connection lines configured to connect the GIP circuit to the plurality of clock signal lines, wherein an overlapping area of the connection lines and the plurality of clock signal lines are configured to be minimized so as to reduce RC delay and implement a narrow bezel, and wherein each of the plurality of clock signal lines has a ring shaped line with four sides.

2. The array substrate for display devices of claim 1, wherein each of the plurality of clock signal lines further comprises an auxiliary clock signal line configured to be connected to the respective clock signal lines via a contact hole thereabove.

3. The array substrate for display devices of claim 1, wherein some of the plurality of clock signal lines that transfer the same signal to the GIP circuit are connected to one another via the connection lines.

4. An array substrate for display devices comprising:

a gate-in-panel (GIP) circuit;

a plurality of clock signal lines configured to transfer signals to the GIP circuit;

an auxiliary clock signal line configures to be connected to the plurality of clock signal lines through a contact hole; and a connection line configured to connect the GIP circuit to the plurality of clock signal lines, wherein the auxiliary clock signal line includes a first auxiliary clock signal line and a second auxiliary clock signal line;

wherein the first auxiliary clock signal line is connected to a first clock signal line through at least two contact holes, and the second auxiliary clock signal line is connected to a second clock signal line though at least two contact holes.

5. The array substrate for display devices of claim 4, wherein the plurality of clock signal lines includes the first clock signal line configured to transfer a first clock signal to the GIP circuit and the second clock signal line configured to transfer a second clock signal to the GIP circuit.

6. The array substrate for display devices of claim 5, wherein the connection line includes a first connection line configured to connect the GIP circuit to the first clock signal line and a second connection line configured to connect the GIP circuit to the second clock signal line.

7. The array substrate for display devices of claim 4, wherein the first auxiliary clock signal line and the second auxiliary clock signal line are formed on the same layer or cross-sectional level, and the first clock signal line and the second clock signal line are formed on the same layer or cross-sectional level.

8. The array substrate for display devices of claim 7, the first auxiliary clock signal line and the second auxiliary clock signal line are formed on a layer different from a layer on which the first clock signal line and the second clock signal line are disposed.

* * * * *